US007708000B2

(12) United States Patent
Mancini

(10) Patent No.: US 7,708,000 B2
(45) Date of Patent: May 4, 2010

(54) ARCHERY BOW HAVING IMPROVED DESIGN TO ABSORB SHOCK REDUCE VIBRATION

(76) Inventor: Ralph J. Mancini, 16 Round Hill Dr., Danbury, CT (US) 06811

( * ) Notice: Subject to any disclaimer, the term of this patent is extended or adjusted under 35 U.S.C. 154(b) by 6 days.

(21) Appl. No.: 12/152,948

(22) Filed: May 19, 2008

(65) Prior Publication Data

US 2008/0216804 A1 Sep. 11, 2008

Related U.S. Application Data

(63) Continuation of application No. 11/329,545, filed on Jan. 11, 2006, now Pat. No. 7,438,070.

(51) Int. Cl.
*F41B 5/00* (2006.01)
*F41B 5/20* (2006.01)

(52) U.S. Cl. ..... 124/23.1; 124/88; 124/89

(58) Field of Classification Search ..... 124/23.1, 124/25.6, 86, 88, 89; 473/578
See application file for complete search history.

(56) References Cited

U.S. PATENT DOCUMENTS

| | | | | |
|---|---|---|---|---|
| 3,169,881 | A | 2/1965 | Bodine | 428/157 |
| 3,365,516 | A | 1/1968 | Prescott et al. | 528/103 |
| 3,518,217 | A | 6/1970 | Irwin et al. | 523/420 |
| 3,553,044 | A | 1/1971 | McDermott | 156/155 |
| 3,661,622 | A | 5/1972 | Rogers | 117/75 |
| 4,080,951 | A | 3/1978 | Bateman | 124/92 |
| 4,257,385 | A | 3/1981 | Stewart | 124/24.1 |
| 4,282,123 | A * | 8/1981 | Ilaria | 528/59 |
| 4,346,782 | A | 8/1982 | Bohm | 181/207 |
| 4,570,608 | A | 2/1986 | Masterfield | 124/89 |
| 4,660,832 | A | 4/1987 | Shomo | 273/73 |
| 4,692,382 | A | 9/1987 | Schmitt et al. | 428/414 |
| 4,693,230 | A | 9/1987 | Sugouchi | 124/88 |
| 4,893,606 | A | 1/1990 | Sisko | 124/89 |
| 5,016,602 | A | 5/1991 | Mizek | 124/89 |
| 5,016,604 | A | 5/1991 | Tilby | 124/92 |
| 5,021,507 | A | 6/1991 | Stanley et al. | 525/127 |
| 5,070,856 | A | 12/1991 | Plummer | 124/88 |
| 5,084,521 | A | 1/1992 | White | 523/436 |
| 5,096,962 | A | 3/1992 | Holmes-Farley et al. | 524/742 |
| 5,099,819 | A | 3/1992 | Simonds et al. | 124/23 |
| 5,114,783 | A | 5/1992 | Hodnett, III | 428/717 |
| 5,132,148 | A | 7/1992 | Raefler | |
| 5,169,922 | A | 12/1992 | Hille et al. | 528/75 |
| 5,254,395 | A | 10/1993 | Hodnett, III | 528/217 |
| 5,267,487 | A | 12/1993 | Falco et al. | 74/558 |
| 5,269,284 | A | 12/1993 | Pujos et al. | 124/88 |
| 5,285,767 | A | 2/1994 | Padilla | 124/87 |
| 5,295,692 | A | 3/1994 | Wright | 473/578 |
| 5,346,112 | A | 9/1994 | Ziemek et al. | 226/173 |
| 5,362,046 | A | 11/1994 | Sims | 473/300 |
| 5,365,650 | A | 11/1994 | Smith et al. | 29/417 |
| 5,368,916 | A | 11/1994 | Fujimoto et al. | 428/215 |
| 5,411,009 | A | 5/1995 | Thompson | 124/89 |
| 5,435,842 | A | 7/1995 | Mukaida et al. | 106/672 |
| 5,452,704 | A | 9/1995 | Winebarger | 124/92 |
| 5,517,979 | A | 5/1996 | Closson | 124/86 |
| 5,532,025 | A | 7/1996 | Kinlen et al. | 427/388.1 |
| 5,653,643 | A | 8/1997 | Falone et al. | 473/300 |
| 5,682,871 | A | 11/1997 | Walk et al. | 124/88 |
| 5,706,794 | A | 1/1998 | Neal | 124/25.6 |
| 5,739,194 | A | 4/1998 | Natesh et al. | 524/457 |
| 5,759,113 | A | 6/1998 | Lai et al. | 473/321 |
| 5,765,845 | A | 6/1998 | Dawda et al. | 280/93.502 |
| 5,772,541 | A | 6/1998 | Buiatti | 473/520 |
| 5,816,233 | A | 10/1998 | Andrews et al. | 124/86 |
| 5,840,797 | A | 11/1998 | Singh | 524/495 |
| 5,881,704 | A | 3/1999 | Andrews et al. | 124/23.1 |
| 5,944,617 | A | 8/1999 | Falone et al. | 473/300 |
| 5,947,099 | A | 9/1999 | Derus | 124/25.6 |
| 6,126,999 | A | 10/2000 | Tomasino et al. | 427/388.4 |
| 6,277,903 | B1 | 8/2001 | Sophiea et al. | 523/428 |
| 6,588,414 | B2 | 7/2003 | McMillan, III | 124/89 |
| 6,669,802 | B2 | 12/2003 | Andrews | 156/245 |
| 6,726,957 | B2 | 4/2004 | Niemiec | 427/327 |
| 6,749,939 | B2 | 6/2004 | Desai et al. | 428/413 |
| 6,841,251 | B2 | 1/2005 | Desai et al. | 428/413 |
| 6,893,366 | B2 | 5/2005 | Falone et al. | 473/568 |

(Continued)

FOREIGN PATENT DOCUMENTS

| | | |
|---|---|---|
| CA | 2304539 | 8/1999 |

OTHER PUBLICATIONS

2006 Quality Archery Designs Catalog.

(Continued)

*Primary Examiner*—John Ricci
(74) *Attorney, Agent, or Firm*—Ralph J. Mancini

(57) ABSTRACT

The present invention generally relates to an improved archery bow having a greatly enhanced ability to absorb shock, vibration and sound. In order to achieve improved sound and vibration dampening, the bow riser, and optionally the bow limbs are coated with an energy absorbing and/or dampening coating. The coating is permanently attached to the riser and/or the limbs of the bow and greatly reduces undesired vibrations and/or noise generated by and during the archery bows use, without interfering with the performance of the bow. The invention also relates to treestands and archery accessories having a low noise profile.

14 Claims, No Drawings

U.S. PATENT DOCUMENTS

| | | | | |
|---|---|---|---|---|
| 7,360,997 | B2 | 4/2008 | Wagner et al. | 416/241 A |
| 2002/0020403 | A1 | 2/2002 | Troubridge | 124/89 |
| 2003/0084893 | A1 | 5/2003 | Andrews | 124/23 |
| 2004/0108051 | A1 | 6/2004 | Andrews et al. | 156/245 |
| 2005/0229912 | A1 | 10/2005 | Pilpet et al. | 124/86 |
| 2007/0007689 | A1 | 1/2007 | Pilpel | 264/238 |

OTHER PUBLICATIONS

PLASTISOL—http://en.wikipedia.org/wiki/Plastisol.

* cited by examiner

ARCHERY BOW HAVING IMPROVED DESIGN TO ABSORB SHOCK REDUCE VIBRATION

FIELD OF THE INVENTION

The present invention generally relates to an improved archery bow having a greatly enhanced ability to absorb shock, vibration and/or sound. In order to achieve improved sound and vibration dampening, the bow riser, and optionally the bow limbs are coated with a sound dampening material in the form of a tough, energy absorbing and/or dampening coating. The coating is bonded or adhered to the riser and/or the limbs of the bow and greatly reduces undesired vibrations generated by and during the archery bows use, without interfering with the performance of the bow.

BACKGROUND OF THE INVENTION

Archery bows are available in a variety of forms. Long bows, recurve bows, compound bows and the like, which are all basically intended to propel an arrow through the transfer of stored energy in the bow through a bow string. A recurve bow may incorporate a rigid handle section to which an opposing pair of flexible limbs are secured in a manner unique to recurve bows and familiar to those in the archery industry. Similarly, a compound bow is provided with a rigid handle portion to which flexible limbs are secured; long bows and similar types of archery bows are usually constructed with the handle and limbs formed in a unitary structure without a discernibly separate handle portion or limbs. Other archery bows are those wherein the limbs are separable from the handle.

Compound bows differ from most bows in that they include wheels or cams attached at the free ends of the limbs to obtain a mechanical advantage in bending the bow. Typically, two eccentrics are used, with lacing wound from an anchor at one end of a first limb to the eccentric at the end of the other limb, to the eccentric at the first end, then back to an anchor at the other end. The middle span between the eccentrics contain the serving or region for receiving the nock of the arrow. Lacing can refer to a single piece bowstring or a three piece line comprising two end cables connected by a central stretch between the wheels which forms the bowstring.

It is well known in the industry that archery bows tend to generate undesirable vibrations and noise during use, which can detract from the performance of the archery bow. During operation the archer nocks an arrow of the bow string and draws his or her bow back to full draw, hoping to shoot the arrow straight and sure to hit a target some distance away. The drawing of the bow to full draw stores kinetic energy in the archery bow and bowstring which, when released, transfers this kinetic energy by a forward thrust to the arrow. When the bowstring is released, most of the stored kinetic energy is transferred to the arrow, causing the arrow to fly according to the force and direction of the bowstring travel. Ideally, all of the stored energy should be transferred to the arrow, but this is not possible due to the physics, mechanics, and dynamics of the bow, bowstring, and arrow system configuration. The energy that is not transferred to the arrow is transferred back into the archery bow and to the archer him/herself. This returned energy appears to the archer as recoil.

This recoil can also cause unwanted vibration and/or noise in the bow. When the bowstring is released, the limbs accelerate forward and engage in a series of rapid vibrations which ultimately die down. This series of vibrations may be so forceful as to affect the flight of the arrow. This can detract from the performance of the bow. Additionally, when hunting, such noise and vibration can cause an animal to move before the arrow strikes the intended target causing misses, or even worse, a wounded animal.

The control of leftover energy which results from the firing of an archery device in the form of vibration and noise has mostly been centered around hydraulic or mechanical dampening devices which were attached to the non-working portion of the bows and which acted independently of the limbs. One known means of controlling recoil forces is disclosed in U.S. Pat. No. 5,362,046 to Sims. The disclosed damper is commercially available and marketed as an archery bow damper, called the "LIMB SAVER". This device has a mushroom-like configuration provided by a head and an integral stem and is fabricated from a soft elastomeric material. The stem is capable of oscillating over a 360° span in directions generally normal to the longitudinal axis of the device. The peripheral part of the head can oscillate around its circumference in directions generally paralleling that axis. For this vibration damping device to function effectively, it is essential that the ratio between the diameter of the head and length l of the stem be between 5:1 and 1:1.

Noise reduction had also been accomplished by the use of string silencers. However such string silencers did not have an effect on vibration and they reduced projectile velocity.

There are several other patents which are alleged to solve the problem of noise and vibration resulting from the above-described leftover energy resultant from the use of an archery bow. Among those patents are the following U.S. patents:

U.S. Pat. No. 4,893,606 discloses a vibration damper in the form of an internal, flow-limiting structure and high density fluid inertial mass which projected from the handle of the bow.

U.S. Pat. No. 5,016,602 provides a bow stabilizer to reduce recoil, shock and vibration forces and noise. This was in the form of a hollow body which was partially filled with granular solids, and which projected from the handle of the bow.

U.S. Pat. No. 5,016,604 discloses a string silencer for an archery bow in the form of a double-faced fleece polyester fabric.

U.S. Pat. No. 4,080,951 provides an archery bow string silencer in the form of fibrous material secured to a flexible support which was connected to the bow string.

U.S. Pat. No. 4,570,608 discloses an archery bow stabilizer and vibration damper in the form of an energy dissipating rod which was fixed to, and projected from, a stud which was rigidly embedded in the archery bow.

U.S. Pat. No. 5,285,767 provides an archery shock absorption device in the form of a flexible connection, (i.e., an elastomeric member) of selected resilience in the structural path between the handle riser of an archery bow and the sighting element of the archery bow.

U.S. Pat. No. 5,411,009 discloses an apparatus for eliminating noise and vibration in the form of a fluid-filled tube which was mounted horizontally to the bow, body and an energy dissipating rod which was fixed to, and projected from, a stud which was rigidly embedded in the archery bow.

U.S. Pat. No. 5,452,704 discloses a device for dampening bowstring vibration in the form of arms normally sprung to a closed position, the arms being faced with cushioning material to embrace the undrawn bowstring.

Finally, U.S. Pat. No. 5,517,979 relates to a shock absorber device for a bow mounted on the bow. The device included a mount which was movable by expansion or compression of a spring in response to the shock generated by the bow.

However, devices and/or methods have proven to be only marginally effective because they cover an insufficient part of the surface area of the archery bow. Additionally, they detract from the performance of the bow by virtue of a reduction of arrow speed. Accordingly, an improved method for dampening shock, vibration and/or noise in compound bows is desirable.

SUMMARY OF THE INVENTION

The present invention generally relates to an improved archery bow having a greatly enhanced ability to absorb shock, vibration and sound. In order to achieve improved sound and vibration dampening, the bow riser, and optionally the bow limbs are coated with an energy absorbing and/or dampening coating. The coating is permanently attached to the riser and/or the limbs of the bow and greatly reduces undesired vibrations and/or noise generated by and during the archery bows use, without interfering with the performance of the bow.

DETAILED DESCRIPTION OF THE INVENTION

The invention generally relates to an archery bow with reduced vibration, shock and/or noise generation during operation. The terms "shock" and vibration are recognized as closely related distinct phenomena. However, because both shock and vibration are closely related, both will be referred interchangeably under the term vibration as is commonly done here for the sake of simplicity and clarity. Both contribute to unwanted bow jump and sound with shock playing the major role in contributing factors in bow jump.

The prior art describes various apparatus designed to absorb vibration and/or shock, but these devices are inadequate in part because the only cover a small portion of the surface area of the archery bow. In contradistinction, in order to reduce vibration, shock and/or noise during operation in accordance with the present invention, a substantial part of the surface area of the bow riser and optionally one or both bow limbs are covered with energy absorbing and/or dampening material. This material effectively dampens excess energy generated during operation of the archery bow thereby reducing the amount of shock, kick, vibration and/or noise generated. Since more of the surface area is covered with the energy absorbing and/or dampening material according to the invention, it is logical that the vibration and/or sound abating affect is superior to that of prior art devices.

The archery bow of the invention is covered with said energy absorbing and/or dampening material. This "covering" can take the form of a coating, or of a tightly fitted sleeve, or a molded sleeve and/or wrap that is fitted to cover a substantial portion of the riser and/or the limbs of the bow. These sleeves and/or wraps can be optionally permanently glued to the bow, or otherwise fastened to the bow with, for example, a Velcro type fastener.

In a preferred embodiment, the covering of said energy absorbing and/or dampening material takes the form of a coating permanently bonded to one or more of the bow riser and bow limbs. This coating can be applied by dipping, spraying, painting, or in any other manner evident to one of ordinary skill in the art.

An archery bow generally comprises a riser extending between opposing first and second end limbs. Each limb, top and bottom, is coupled to each end of the riser of the bow. In accordance with the invention, the vibration and/or sound abating coating is temporarily, or preferably permanently affixed over a substantial amount of the surface area, or preferably all, or nearly all of the exposed surface area of the riser and/or limbs of the archery bow. Because virtually all of the exposed surfaces of the bow is covered with said vibration and/or noise abating material, the bow itself has a far superior vibration and noise dampening effect than the apparatus and/or methods proposed by the prior art.

The vibration and/or noise abating covering and/or coating can be used with any particular bow, whether a longbow, crossbow, recurve bow, traditional bow and/or a compound bow and the like. In one embodiment of the invention the archery bow is a compound bow.

The energy absorbing and/or dampening material useful in the context of the invention can be any material with the capacity to absorb or dampen excess energy, shock, vibration and/or noise generated during the operation of an archery bow. Such coating should be durable and also have the ability to be conveniently and economically attached or permanently bonded to one or more archery bow components, including but not limited to one or more of the bow riser, limbs, and the like.

Examples of energy absorbing and/or dampening materials useful in the context of the invention include, but are not limited to, elastomeric materials. "Elastomer" and "elastomeric" are words of art. Elastomers are polymeric materials which can be rapidly stretched to their elastic limit (typically 200-1000 or more percent) and which snap or rebound to their original shape and dimensions when the "stretching" force is removed. Elastomers are thus defined in terms of their physical properties. Elastomeric is the adjective counterpart of, and has essentially the same meaning as, elastomer. The selected elastomeric material may or may not be viscoelastic. If it is, the response of the material to the imposed load arising from shock and vibration will have both viscous and elastic qualifiers.

Specific examples of energy absorbing and/or dampening materials useful in the context of the invention include, but are not limited to, elastomeric materials and/or polymers including, but not limited to rubber, elastomeric rubbers, elastic and/or vinyl (co)polymers, rubber copolymers, polyurethane, e.g., Sorbothane™ (Sorbothane Inc., Kent, Ohio), Navcom™ (Allsop/Sims Vibration, Bellingham, Wash.), Line-X™ (Line-X Protective Coatings), or Tuff Stuff® (Rhino Linings and Coatings, Tualatin, Oreg.), viscoelastic rubber such as Smactane®, Smacsonic® (SMAC, Branly, France), polyurea coatings such as Duracoat™ (DuraCoat America), styrene-butadiene-styrene-, styrene-ethylene/butylene-styrene, styrene-ethylene/propylene-styrene, styrene-isoprenestyrene, polyisoprene, ethylene-propylene diene rubbers (EPDM), chlorinated rubbers, nitrile rubbers, methylmethacrylate styrene-butadiene block copolymers, polybutadiene, acrylonitrile-butadiene-styrene copolymers, rubber acrylic (co)polymers and so forth, just to mention a few. Any of these materials can be optionally crosslinked, if necessary to meet the performance and durability standards of the present invention.

Additionally, certain thermosetting polymeric materials can meet the requirements of the vibration and/or noise abating material of the present invention. Examples of such materials include, but are not limited to unsaturated polyesters, epoxy resins, vinyl ester resins, phenolic resins, polyether, polyester and polyurea urethanes, urethane-acrylic composites and/or materials, and the like. Such materials can advantageously be crosslinked with styrene, amines, vinyl toluene, hexamethylenetetramine, and the like.

Examples of such vibration and/or noise abating material materials useful in the context of the present invention abound in the prior art. For example, useful coatings are disclosed in the following U.S. patents, which are all incorporated herein by reference" U.S. Pat. No. 5,084,521; U.S. Pat. No. 5,739, 194; U.S. Pat. No. 5,096,962; U.S. Pat. No. 4,692,382; U.S. Pat. No. 5,114,783; U.S. Pat. No. 3,661,622; U.S. Pat. No. 5,532,025; U.S. Pat. No. 4,282,123; U.S. Pat. No. 5,169,922; U.S. Pat. No. 5,254,395; U.S. Pat. No. 5,346,112; and U.S. Pat. No. 6,942,586, U.S. Pat. No. 5,653,643, U.S. Pat. No. 5,944,617, U.S. Pat. No. 6,126,999 and U.S. Pat. No. 5,021,507.

The coating of the present invention can be applied in one layer or in multiple layers of the same or alternating materials, with or without an adhesive, depending on the materials and conditions chosen. The coating should be of minimal thickness necessary to achieve the desired energy absorbing/dampening characteristics. In one embodiment, the coating can have an intermediate layer preferably made from a force dissipating or stiffening material such as aramid fibers, fiberglass materials, and the like. The surface of the coating can optionally include a gripping layer, optionally contain grit or other material for sure grip.

Additionally, the coating, molding and/or sleeve of the invention can be clear or optionally contain a color tint or camo pattern. As deer have been proven to be able to discern uv light/brighteners, the coating employed can also contain uv suppressing materials and/or pigments thereby rendering the archery bow invisible or nearly invisible to deer and other animals able to discern objects in this light spectrum.

Finally, the invention is not limited in its application to archery bows. The principles of the invention can be equally useful in coating archery accessories such as sights, arrow rests, trigger releases, bow pulleys and cams, arrows, quivers, broadheads and the like.

Additionally, the present invention can be very advantageously applied to all types of treestands making them less susceptible to vibration and/or sound. It is understood that by treestand, the present inventors intend to cover portable, climbing, fixed, ladder, tripod, and any other type of treestand available to the sportsman. Such coating can also contain uv suppressors and gripping materials, such as tack or grit, if necessary. Treestands of a hollow tube design are especially susceptible to sound and can greatly benefit from the present invention, but treestands having a grate like platform and/or seat can also benefit greatly from the technology herein, as can treestands made from cast metal and/or metal alloys. Further, in addition to coating the platform and/or seat elements of a treestand, various support elements, and in the case of a ladder stand, the ladder portion of the treestand can be coated for optimal benefit.

While the invention has been described in the more limited aspects of the preferred embodiments thereof, other embodiments have been suggested and still others will occur to those skilled in the art upon reading and understanding the foregoing specification. It is intended that all such embodiments be included within the scope of this invention.

I claim:

1. An archery bow comprising a riser wherein at least substantially all of the surface area of said riser is coated with an elastomeric energy absorbing and/or dampening material, and wherein attached to said riser are a first and second flexible end limbs, and wherein optionally at least one of said limbs is coated with an elastomeric energy absorbing and/or dampening material.

2. The archery bow of claim 1 wherein said elastomeric energy absorbing and/or dampening material is crosslinked with an agent chosen from styrene, amines, vinyl toluene, or hexamethylenetetramine, or mixtures thereof.

3. The archery bow of claim 1 wherein said coating of elastomeric energy absorbing and/or dampening material is applied to said riser by spraying, dipping, painting and/or said coating is molded to said riser, wherein said coating is formed in a single layer, or in multiple layers, wherein if formed in multiple layers, said layer(s) comprise the same or different elastomeric energy absorbing and/or dampening materials.

4. The archery bow of claim 1 wherein said elastomeric energy absorbing and/or dampening material coating comprises an intermediate layer that comprises a stiffening material, wherein said stiffening material comprises aramid fibers, fiberglass fibers, or mixtures thereof.

5. The archery bow of claim 1 wherein said energy absorbing and/or dampening material additionally comprises one or more of a gripping additive or gripping layer, uv dampener, color tint, and camo pattern.

6. The archery bow of claim 1 wherein said bow is a compound bow, a crossbow, a recurve bow, or a longbow.

7. The archery bow of claim 1 wherein said elastomeric energy absorbing and/or dampening material is optionally crosslinked and is chosen from rubber, elastomeric polymers, elastomeric rubber, elastic and/or vinyl (co)polymers, rubber copolymers, polyurethane, viscoelastic rubber polyurea coatings, styrene-butadiene-styrene-, styrene-ethylene/butylene-styrene, styrene-ethylene/propylene-styrene, styrene-isoprenestyrene, polyisoprene, ethylene-propylene diene rubbers, chlorinated rubbers, nitrile rubbers, methylmethacrylate styrene-butadiene block copolymers, polybutadiene, acrylonitrile-butadiene-styrene copolymers, rubber acrylic (co)polymers, unsaturated polyesters, epoxy resins, vinyl ester resins, phenolic resins, polyether, polyester and polyurea urethanes, urethane-acrylic composites, and mixtures thereof.

8. The archery bow of claim 1 wherein said elastomeric energy absorbing and/or dampening material is optionally crosslinked and is chosen from rubber, elastomeric rubber, rubber copolymers, viscoelastic rubber, chlorinated rubbers, nitrile rubbers, elastomeric polymers and mixtures thereof.

9. The archery bow of claim 1 wherein said elastomeric energy absorbing and/or dampening material is optionally crosslinked and is chosen from styrene-butadiene-styrene-, styrene-ethylene/butylene-styrene, styrene-ethylene/propylene-styrene, styrene-isoprenestyrene, polyisoprene, ethylene propylene diene rubbers, chlorinated rubbers, nitrile rubbers, methylmethacrylate styrene-butadiene block copolymers, polybutadiene, acrylonitrile-butadiene-styrene copolymers, and mixtures thereof.

10. The archery bow of claim 1 wherein said elastomeric energy absorbing and/or dampening material is optionally crosslinked and is chosen from rubber acrylic (co)polymers, elastic and/or vinyl (co)polymers, unsaturated polyesters, epoxy resins, vinyl ester resins, and mixtures thereof.

11. The archery bow of claim 1 wherein said elastomeric energy absorbing and/or dampening material is optionally crosslinked and is chosen from phenolic resins, polyether, polyester, polyurea, polyurea urethanes, urethane-acrylic composites, and mixtures thereof.

12. The archery bow of claim 1 wherein said elastomeric energy absorbing and/or dampening material is optionally crosslinked and is chosen from polyurethane.

13. The archery bow of claim 1 wherein said bow is a compound bow.

14. The archery bow of claim 1 wherein said bow is a crossbow.

* * * * *